United States Patent [19]

Vallee

[11] 4,034,530

[45] July 12, 1977

[54] SHEET METAL ROOFING SYSTEM

[76] Inventor: Louis Léonce Vallee, 6392 Maubourg Ave., Montreal, Quebec, Canada, H1M 2C8

[21] Appl. No.: 619,504

[22] Filed: Oct. 3, 1975

[30] Foreign Application Priority Data

Aug. 21, 1975 Canada ..... 233923

[51] Int. Cl.[2] ..... E04D 3/366; E04D 3/40

[52] U.S. Cl. ..... 52/463; 52/520; 52/465; 52/543; 29/433; 29/469; 29/526

[58] Field of Search ..... 52/479, 22, 94, 45, 52/54, 459–471, 529–531, 49, 58, 82, 520; 29/433, 526

[56] References Cited

U.S. PATENT DOCUMENTS

| | | | |
|---|---|---|---|
| 222,842 | 12/1879 | Sagendorph | 52/530 |
| 356,393 | 1/1887 | Helliwell | 52/58 |
| 612,024 | 10/1898 | Drake | 52/49 |
| 673,218 | 4/1901 | Panner | 52/543 |
| 1,210,855 | 1/1917 | Shainwald | 52/466 |
| 1,974,351 | 9/1934 | Walten et al. | 52/466 |
| 2,178,415 | 10/1939 | Ansel | 52/545 |
| 2,360,107 | 10/1944 | Cardarelli | 52/58 |
| 3,327,443 | 6/1967 | Gay et al. | 52/460 |
| 3,453,794 | 7/1969 | Blok | 52/530 |
| 3,762,121 | 10/1973 | Herman | 52/520 |

*Primary Examiner*—James L. Ridgill, Jr.
*Attorney, Agent, or Firm*—Fetherstonhaugh and Company

[57] ABSTRACT

A roofing system of the batten type using sheet metal components with wooden or metallic batten supports.

With the batten supports in place elongated pan sections are laid between the batten supports and secured to the roof by nails or screws at the top or near the top of the adjacent batten supports. Each pan section has a wide flat elongated central region which lies flat on the roof and which is centrally located between two similar upstanding side walls running the full length of the central region and fitting between two successive battens. Each side wall has an inner, downwardly directed double fold running along the side of the adjacent batten support and terminating short of the central region. A batten covering cap having a centrally located top and downwardly directed wings each with an inner upwardly folded edge fitting behind the double fold is positioned in place by sliding it longitudinally over the associated batten support. Two different pan designs are given, one having the terminal edges of its side walls turned 90° outwardly thus providing a narrow margin lying flat over the top of the batten supports and designed to receive fasteners such as screws the other terminating vertically.

13 Claims, 8 Drawing Figures

SHEET METAL ROOFING SYSTEM

Figure 1:
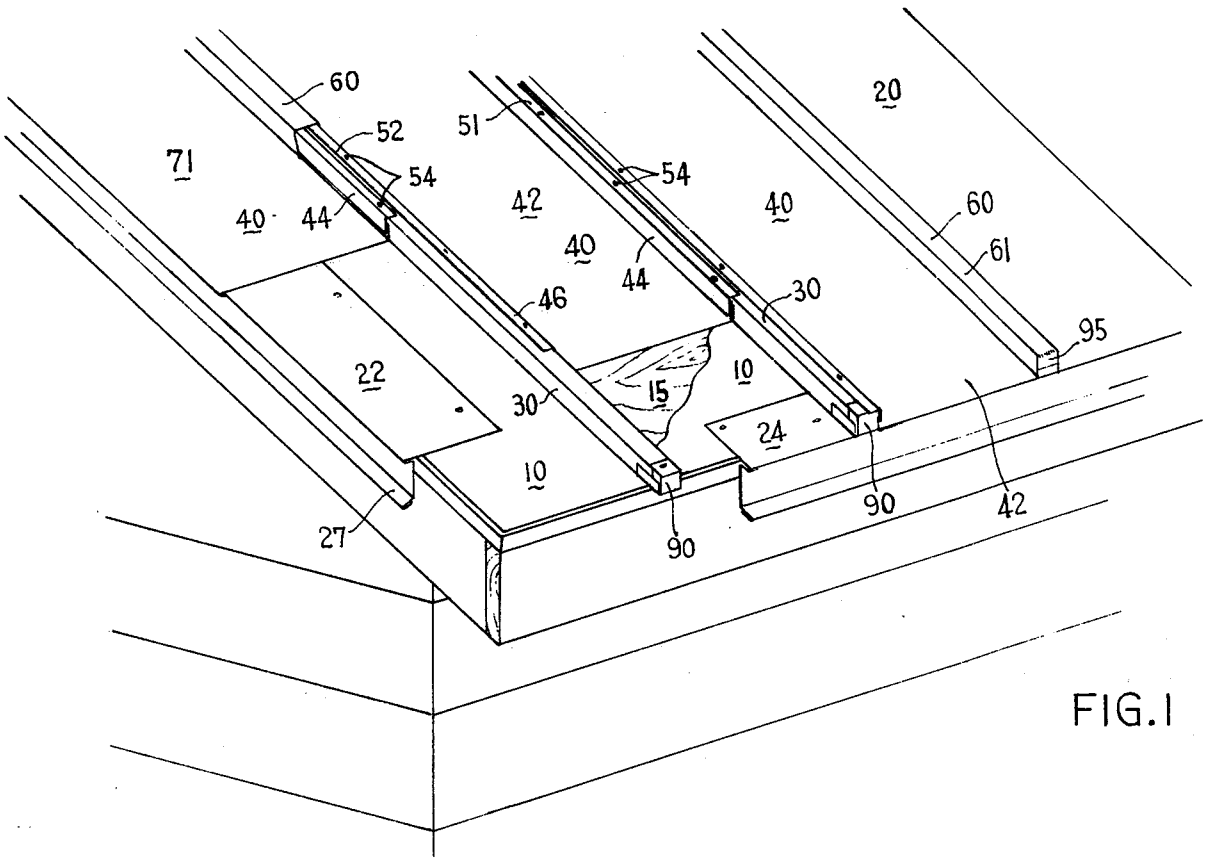

This invention relates to a metal roofing system to be installed on roofs having at least a slight slope, and in particular to roofs of the batten type.

Metal roofs are well known and one of the conventional metals used in roof covering is copper in sheet form which can be nailed directly to the underlying wooden structure and the nails can be waterproofed by brazing. The adjacent sheet metal components can also be brazed together. The appearance is enhanced when regularly spaced apart battens are used which facilitates the installation of the roof and also the repair work that may have to be done from time to time. However brazing is time consuming and requires skilled labour with the result that conventional batten copper roofs are prohibitive to family housing projects.

Various attempts have been made to design metal roofing systems where the individual components are nailed or screwed to the underlying structure but where no soldering is required due to the use of covering and overlapping technique. Examples of such metal roofing systems of recent design will be found in U.S. Pat. No. 3,603,056 to ROTH, issued on Sept. 7, 1971 and Pat. No. 3,762,121 to HERMAN, issued on Oct. 2, 1973. However all known prior metal roofing systems either lack in waterproofing or were found to be insufficiently rigid except when using comparatively thick sheet metal or, in the case of soldered copper roofing are prohibitively expensive.

The object of this invention is to provide a metal and roofing design which is cheap to manufacture and easy install without the need to braze or weld the parts together and which is sufficiently rigid even when using thin, prepainted aluminum sheet material and which will be comparable from the point of view of outside appearance, durability and waterproofing as the conventional copper roofing of the batten type.

I have found that these objects can be fully satisfied in a roofing system of the batten type where the main elements, hereinafter referred to as pan sections have a wide flat elongated central region with two similar upstanding side walls each with an inner downwardly directed double fold behind which a channel shaped batten covering cap having inwardly folded edges can be fitted by longitudinal sliding. By using screws to secure the pan sections to the batten supports, one obtains a very secure metal roof covering whose individual components can be very easily removed for making repairs or modifications.

Thus this invention provides a metal roofing system of the batten type comprising parallel equally spaced apart batten supports secured to the roof over a waterproofing paper or the like and extending in the direction of the slope of the roof, a plurality of pan sections each having a central region and two identical vertically projecting walls with an inner downwardly directed double fold along each wall parallel to the central section and vertically spaced thereabove a short distance. Each wall terminates into a narrow strip for driving fasteners therethrough into the adjacent batten support, there being no other fasteners to hold said pan sections in place on said roof, and a batten covering cap made of thin sheet metal folded in the shape of an inverted U whose depending wings terminate into inner upwardly directed edges for fitting under the double folds of the pan sections. For a proper fit, the edges of the peripheral pan sections are cut to be slightly in excess of the adjacent eave starter and are folded downwardly and then inwardly underneath the protruding flange of the eave starter.

The invention provides two different pan section designs; on each case there is a narrow fastener receiving margin on each side wall above the double fold. In one embodiment each narrow margin is vertical and in the other it is bent at 90° outwardly in a plane parallel to the central region of the pan section and vertically spaced therefrom over a distance that corresponds to the thickness of the batten supports. A batten covering cap is also provided which is an inverted U-shaped element made of folded thin sheet metal and the free ends of its legs are folded inwardly and upwardly in such a way as to closely fit behind the double folds of adjacent pan sections.

A method for covering a roof which is at least slightly inclined is also provided. It comprises the steps of placing over the bare surface of the roof a waterproofing layer of tar paper or the like, securing eave starter and gable starters, and securing parallel batten supports at equally spaced apart locations on the roof in the direction of the slope. Pan sections are then installed between the batten supports and then batten covering caps are slided lengthwise over each batten support for covering the fasteners receiving holes in the marginal edges of the adjacent pan sections and for covering the longitudinal joints between contiguous pan sections.

Figure 2:
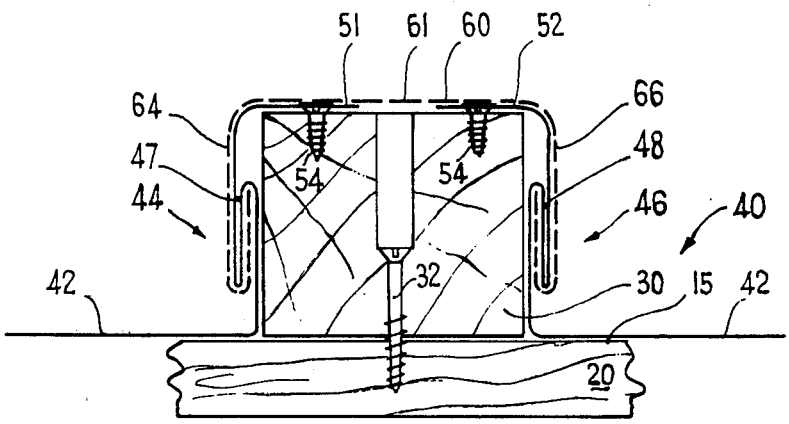
Figure 8:
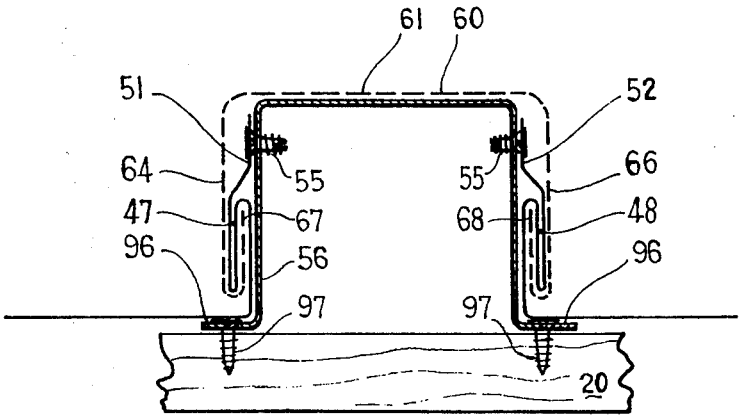
Figure 5:
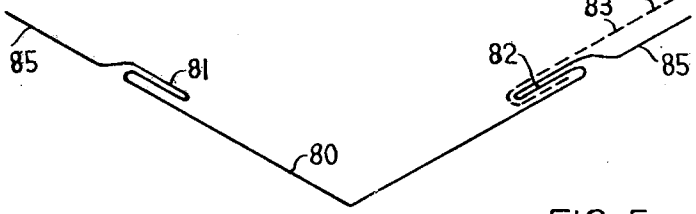
Figure 7:
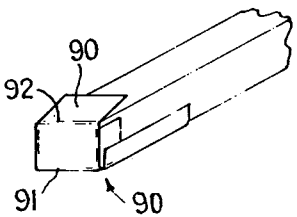
Figure 6:
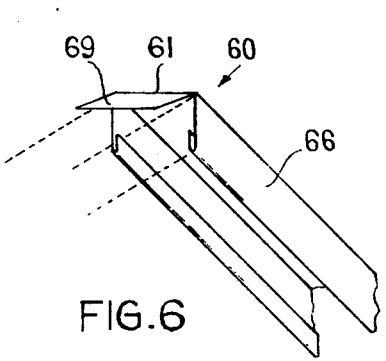
Figure 3:
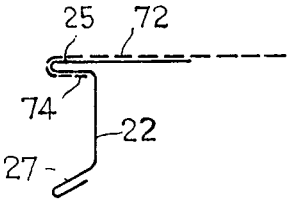
Figure 4:
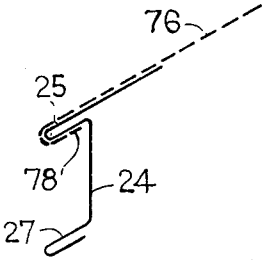

A examplary embodiment of this invention will now be described in details with reference to the accompanying drawings wherein:

FIG. 1 is a perspective view of a corner of a sloping roof with a metal roofing system some of whose parts being removed or cut away for illustration purposes, FIG. 2 is a cross-sectional view taken through a batten support and illustrating the profile of a batten covering cap and of the side portions of two associated pan sections, FIG. 3 is the illustration of the profile of a side gable starter, FIG. 4 is the illustration of the profile of a front eave starter, FIG. 5 is an illustration of a gully and valley flashing, FIG. 6 is the upper end portion of a batten covering cap, FIG. 7 is a perspective view of a batten support and cap and, FIG. 8 is a view similar to that of FIG. 2 but illustrating a modified pan section construction on a different type of batten support.

Referring now to FIGS. 1 to 7 of the drawings, an improved metal covering is illustrated which comprises a layer of waterproof paper 10 layed over the bare surface 15 of an at least slightly sloping roof 20. In order to simplify the illustration, the layer of waterproofing material such as tar paper 10 is not shown in FIG. 2 where the various components are shown as being spaced apart.

Peripheral eave starters including gable starter 22 and eave starter 24 are disposed over the marginal edges of the waterproofing material and have a protruding flange 25 which extends slightly beyond the edges of the roof surface starters 22, 24 at least partially cover the facing of the roof and include a downwardly and outwardly extending flange 27, all of which being standard in the trade of roof covering.

A plurality of parallel equally spaced apart batten supports 30 are secured to the roof 20 by means of fairly long wood screws 32 which pass through a countersunk bore in the batten supports and project into the roof underlying structure 20. The centre-line spacing of the batten supports is generally 18 inches. The batten supports 30 can be 2 × 2 wooden elements but as will be described below with reference to FIG. 8, the batten supports can be a U-shaped metallic structure. Obviously the batten supports will extend in the direction of the slope of the roof so as to facilitate elimination of water and moisture.

A plurality of pan sections 40 are then secured to the roof over the layer of waterproofing material 10 and between the successive batten supports 30. Each pan section 40 has a central region 42 which is flat and elongated and whose width corresponds to the distance between the facing sides of successive batten supports 30. There are two identical vertically projecting walls 44 and 46 each with a downwardly directed double fold 47 and 48 extending parallel to the central region 42 but terminating a short distance thereabove. Each side wall 44 and 46 terminates into a longitudinal narrow margin 51 and 52 which are used for driving fasteners 54 therethrough into the underlying batten supports 30. Thus, as seen in FIG. 2 the only portions of the pan sections 42 which are being punctured are these narrow margins 51 and 52 which are disposed over the top of the batten supports 30. In the slightly modified pan section design shown in FIG. 8, the longitudinal narrow margins 51 and 52 extend vertically instead of beinb bent outwardly at an angle of 90° as indicated in FIG. 2, but here again the screws 55 which extend through the margins 51 and 52 will reach the upper portion of the underlying batten supports which could be made of wood as at 30 in FIG. 2 or which could be U-shaped metal components 56 as seen in FIG. 8.

Over each batten support 30 or 56 a batten covering cap 60 is provided which is also made of thin sheet metal and it comprises a top portion 61 shown as dotted lines in the FIGS. 2 and 8 lying over the associated batten support 30 or 56 and two downwardly directed essentially vertical wings 64 and 66 each having an inner upwardly folded edge 67 and 68 closely fitting behind the associated pan section double folds 47 and 48. The installation of the cap supports 60 is accomplished by sliding same longitudinally starting from the lowest end of the batten supports. As seen in FIG. 6, the upper extremity of each batten cap 60 will have an extension 69 projecting beyond top surface 61 and folded over the top of the batten on the opposite side of the roof, assuming a pointed roof design.

With reference to FIGS. 2 and 8 one should bear in mind that these are illustrative drawings and that in practice there will be very little spacing if any between the contacting surfaces of adjacent components.

Wooden screws are used for fastening the opposite margins of the pan sections 42 to the wooden batten support 30. However suitably secured nails could also be used, in particular fluted nails. It is felt however that although screws may take more time to install, a more secure roofing system should result. Beyond the last batten support, the pan section such as that shown at 71 in FIG. 1 will only have one vertical wall 44 and the opposite edge 72 will be cut slightly wider than necessary so as to be bent downwardly and then inwardly as at 74 in FIG. 3 thereby to cover protruding flange 25 of gable starter 22. Similarly the lowest edge of the pan sections 40 as at 76 will be cut long enough to be bent downwardly and inwardly as shown at 78 in FIG. 4 thereby to extend over and cover projection 25 of eave starter 24.

For gullies and valley flashings a component 80 is illustrated in FIG. 5 in cross-section which also uses downwardly projecting double folds 81 and 82 for receiving therebehind a folded edge 83 of the associated pan section 40, and a narrow margin 85 beyond double folds 81 and 82 will be used for receiving fasteners such as screws or nails.

In order to properly protect the lowest end each of batten support 30 an end cap 90 is used as shown in FIG. 7 in slightly enlarged scale compared to FIG. 1. It is essentially a channel made of thin sheet metal and cut in such a way as to bend over the end of the batten support along two lines 91 and 92 and provide an upper extension 93 which receives a screw or nail for holding the end cap in place. As noted above the lowest edge 76 of pan section 40 should be cut long enough so as to extend slightly beyond the eave starter 24. The associated side walls 44 and 46 should be cut the same length and separated from the region 42 so that they may be folded over the ends of the batten support 30 partially covering the ends of cap 90. Moreover the lowest end of each batten covering cap 60 should have a slight extension 95 of its top surface 61 for bending downwardly over the end of the associated batten. It might be added that in the case of a double sloping roof the central regions 42 of pan sections 40 will overlap one another slightly over the ridge of the roof. In certain cases, and depending on the slope of the roof, a strip of rubber-base adhesive material may be inserted between the overlapping portions of the metal components covering the ridge of the roof. A suitable sealing strip for this application is produced by Revere Company and sold under the trade mark SELF-SEAL.

In the embodiment illustrated in FIG. 8 a very narrow strip of such a sealing material could be installed along the side edges of batten support 56 immediately underneath the longitudinal narrow margins 51 and 52 for added waterproofing. This precaution should not be necessary in the case of pan sections 40 which are nailed over the top of the batten supports as shown in FIG. 2 even with very slightly sloping roofs, for example a slope of the order of 1 to 10.

In FIG. 8 batten support 56 consists of a one piece metal component which is essentially U-shaped with outwardly directed flanges 96 through which wood screws 97 are driven for securing same to the underlying wooden roof structure 20. Such metallic batten supports 56 should be as strong as the wooden batten supports 30 noted above and consequently the use of aluminum about 0.040 of an inch thick is preferred although properly protected galvanized steel of about 0.016 inches thick can also be used.

The screws 55 used for securing the roofing components to the metallic batten supports 56 should be self-tapping flat heat metal screws 97 which secure the metallic batten supports 56 to the roof are preferably self-tapping flat head wood screws.

It has been determined that one of the best sheet metal for the above described roofing metal system is prepainted aluminum having a thickness of the order of from about 0.025 to 0.040 of an inch on account of its lightweight and strength. Thus the pan sections and the batten covering caps can be prefolded in different length ranging from 8 to 20 feet.

A slight amount of lubricant greatly facilitates sliding of the batten covering caps in place; a liquid which washes easily such as soap or detergent is preferred.

For repairs or when it is desired to modify the roof as when putting in an extra room to an existing structure, it is easy to remove the required number of batten covering caps and pan sections even without damaging them. Only those batten covering caps which were too difficult to pull out without cutting or tearing will ultimately have to be replaced by new ones.

The embodiments of the invention in which an exclusive property or privilege is claimed are defined as follows:

1. An improved metal roof covering comprising a plurality of parallel, equally spaced apart batten supports secured to said roof and extending in the direction of the slope of the roof, a plurality of pan sections each having a central region and two identical vertically projecting side walls with an inner downwardly directed double fold along each wall parallel to said central section and vertically spaced thereabove a short distance, each side wall terminating in a narrow strip located above the double fold for driving fasteners therethrough into the adjacent batten, there being no other fasteners to hold said pan sections in place on said roof, and a batten support covering cap made of thin sheet metal folded in the shape of an inverted U whose depending wings terminate into inner upwardly directed edges for fitting under said double folds.

2. The improved metal roof covering defined in claim 1 wherein said batten support comprises an inverted U-shaped folded component made of metal and having two outwardly directed flanges for receiving fasteners.

3. The metal roof covering designed in claim 1 wherein said pan sections and said batten support covering caps are made of prepainted aluminum sheeting of approximately 0.025 to 0.040 an inch thick.

4. The improved metal roof covering defined in claim 1, including a layer of water-proof sheet material such as water-proof paper or the like layed over a bare surface of an at least slightly sloping roof, peripheral eave starters disposed over the marginal edges of said sheet material and extending slightly beyond the edges of said surface of the roof and then inwardly and downwardly along at least part of the facing of said roof, the said batten supports located over said paper and eave starters, and wherein the edges of the peripheral pan sections are cut to be slightly in excess of the adjacent eave starters and folded downwardly and then inwardly against the said eave starters.

5. The improved metal roof covering according to claim 1, wherein said narrow margins extend normal to said central region.

6. The improved metal roof covering according to claim 1, wherein said narrow margins are bent outwardly so as to be parallel to said central regions and vertically spaced therefrom a distance corresponding to the height of the roof's batten supports.

7. For use in a metal roofing system of the batten type, a single piece prefolded pan section made of thin metal covering an area of a roof between two successive parallel batten supports spaced apart a predetermined distance, comprising a flat elongated central region whose width corresponds to the distance between the facing sides of said batten supports, and two upstanding side walls each defining opposite side edges of the central region of the pan sections, each of said side walls having an outer facing component projecting upwards from the said central region a distance short of the height of the said batten supports and in contact with side surfaces thereof, a mid component folded downwards from the upper edge of said outer facing components and in spaced relation thereto, and an inner facing component folded upwards from the lower edge of the said mid component immediately adjacent thereto and forming terminal portions of said inner facing component located above the upper edge of said outer facing component for attaching the same to the said batten supports and means to secure the said terminal portions of the inner facing components to the said batten supports, and a prefolded batten covering cap of sheet material, the said cap having a central portion and a pair of side walls projecting downwardly from said central portion, said latter side walls being folded inwardly and upwardly upon themselves, the said cap adapted for sliding contact over the terminal portions of adjacent pan sections secured to the upper surface of a batten support, and between the outer facing component and the mid component of the side walls of adjacent pan sections.

8. For use in a metal roofing system of the batten type, a pan section as defined in claim 7 wherein said margins are normal to said central region.

9. For use in a metal roofing system of the batten type, a pan section as defined in claim 7 wherein each margin is bent outwardly so as to be parallel to said central region and vertically spaced therefrom a distance corresponding to the height of the roof's batten supports.

10. The pan section defined in claim 7 when made of prepainted aluminum sheeting approximately 0.025 to 0.040 of an inch thick.

11. A method for covering a roof which is at least slightly inclined with thin sheet metal components comprising the steps of: prefolding a thin metal sheet into metal pan sections by forming a wide flat elongated central region, and forming two upstanding side walls by double folding both ends of the thin metal sheet up to form outer facing components, and then down back toward the central region of the metal pan to form mid-components which terminate above the surface of the central region, and then back up to form inner facing components which terminate above the outer facing components to form longitudinal narrow margins, fixedly securing on the roof equally spaced apart parallel batten supports of a height extending above the said outer facing components and running the entire distance along the slope of the roof, positioning the elongated folded thin sheet metal pan sections between the batten supports for covering the roof's surface with the wide flat elongated central regions centrally located between two upstanding batten supports and the side walls each located adjacent a batten support with the longitudinal narrow margins located adjacent the batten supports, securing each pan section to the adjacent batten supports by means of fasteners passing through said narrow margins and projecting into said batten supports along the upper region thereof with said central region flat against said roof, and longitudinally sliding over each batten support a prefolded sheet metal batten covering cap having an elongated, centrally located top, and two downwardly directed wings each with an inner upwardly folded edge fitting behind said double folds between the mid-component and the inner facing component.

12. The roofing method defined in claim 11 wherein said narrow margins of said pan sections are essentially normal to said central section, wherein said fasteners are screws compatible with the batten supports in use, and wherein the step of securing the pan sections comprises driving said screws through said narrow margins at spaced apart points therealong and into the adjacent batten supports but near the top portion thereof.

13. The roofing method defined in claim 11 wherein said narrow margins are bent outwardly at about 90° along a line of said side walls which is vertically spaced from said central portion over a distance equal to the height of the batten supports in use, wherein said fasteners are screws that are compatible with said batten supports and wherein the step of securing said pan sections comprises driving said screws through said margin at spaced apart points therealong and into the underlying batten supports through the top surface thereof.

* * * * *